US005169083A

United States Patent [19]

Sannohe et al.

[11] Patent Number: 5,169,083

[45] Date of Patent: Dec. 8, 1992

[54] NARROW STRIP WINDING METHOD

[75] Inventors: Takeshi Sannohe; Sinji Hasumi; Hidehiko Sou, all of Kanagawa, Japan

[73] Assignee: Nippon Mining Co., Ltd., Tokyo, Japan

[21] Appl. No.: 594,180

[22] Filed: Oct. 9, 1990

[30] Foreign Application Priority Data

Oct. 19, 1989 [JP] Japan ..... 1-272030

[51] Int. Cl.[5] ..... B65H 18/28

[52] U.S. Cl. ..... 242/67.1 R; 242/1

[58] Field of Search ..... 242/67.1 R, 55, 158 R, 242/158.4 R, 159, 163, 166, 171, DIG. 2

[56] References Cited

U.S. PATENT DOCUMENTS

| | | | |
|---|---|---|---|
| 3,161,372 | 12/1964 | Kaufmann | 242/176 |
| 3,231,217 | 1/1966 | Justice, Jr. | 242/159 |
| 3,963,186 | 6/1976 | Van der Aa | 242/158 R X |
| 3,997,122 | 12/1976 | Helfand et al. | 242/55 X |
| 4,352,467 | 10/1982 | Dunn et al. | 242/DIG. 2 X |
| 4,477,036 | 10/1984 | Rundo | 242/55 X |
| 4,545,549 | 10/1985 | Rundo | 242/158.4 R |
| 4,568,033 | 2/1986 | O'Connor | 242/67.1 R X |
| 4,603,817 | 8/1986 | O'Connor | 242/67.1 R X |
| 4,802,636 | 2/1989 | Frick et al. | 242/67.1 R |

FOREIGN PATENT DOCUMENTS

| | | | |
|---|---|---|---|
| 781308 | 3/1968 | Canada | 242/158 |
| 2098246 | 11/1982 | United Kingdom | 242/159 |

OTHER PUBLICATIONS

Western Electric Technical Digest No. 27, "Traverse-Wound Spools for Component Taping Machine", R. W. Ingham, Jul. 1972.

*Primary Examiner*—Daniel P. Stodola
*Assistant Examiner*—John P. Darling
*Attorney, Agent, or Firm*—Seidel, Gonda, Lavorgna & Monaco

[57] ABSTRACT

A method of winding a narrow strip having a width W on a bobbin at an angle$\theta$ to the rotational axis of the bobbin and at a pitch P, while the bobbin and the strip are being relatively traversed over an axial stroke S of the bobbin, characterized in that setting the integral part as A and the decimal part as B of the calculated numerical value of rotational number n the bobbin per reciprocating traverse of the bobbin or strip which is expressed according to the formula $n=2\ S/P$, the winding is carried on, in the case when $P<2W/\sin\theta$, while controlling at least any one of P, S, and $(P-W/\sin\theta)$ so that $(1-W/P\ \sin\theta)<B<W/P\ \sin\theta$. Thus, A narrow strip can be soundly wound on a bobbins while avoiding any collapse or other disorder in winding or any damage of the strip by adjusting the value of B that depends delicately upon the values of P and S.

2 Claims, 4 Drawing Sheets

NARROW STRIP WINDING METHOD

FIELD OF THE INVENTION

This invention relates to a method of winding a narrow strip of metal or the like on a bobbin.

The term "narrow strip" as used herein means any of bands, ribbons, tapes or other similar long, narrow-width strips capable of being wound around a bobbin.

BACKGROUND OF THE INVENTION

One method of winding a narrow strip of metal or the like on a bobbin, commonly called as traverse winding, consists of carrying on the winding while moving the bobbin or strip laterally in reciprocating traverses.

The soundness of the wound state in the traverse winding method depends on the winding conditions used. When the conditions are good, the narrow strip 1 is wound uniformly on the bobbin 2 as indicated in FIG. 5 (*a*). When the conditions are poor, the layered turns 1*a* of the strip at opposite ends on the bobbin may be depressed or collapsed as in FIG. 5 (*b*).

As stated above, in winding a narrow strip on a bobbin by traverse winding, inappropriate winding conditions have sometimes caused depression of the strip portions at or close to the both ends of the bobbin, leading to collapse or damage or break of the strip during winding. It has been in practice in such a situation to conduct the winding while finely adjusting the winding pitch of the strip on the bobbin. This has posed a problem of reduced efficiency of winding operation.

OBJECT OF THE INVENTION

The present invention has now been perfected in view of the foregoing. This invention is aimed at providing a narrow strip winding method whereby a strip can be wound soundly on a bobbin while preventing any collapse or damage of the strip during winding.

SUMMARY OF THE INVENTION

The above object is achieved, in accordance with the invention, by a method of winding a narrow strip or the like having a width W on a bobbin at an angle$\theta$ to the rotational axis of the bobbin and at a pitch P, while the bobbin is being traversed with respect to the strip or vice versa back and forth over an axial stroke S of the bobbin, characterized in that, setting the integral part as A and the decimal part as B of the calculated numerical value of rotational number n the bobbin per reciprocating traverse of the bobbin or strip which is expressed according to the formula $n=2S/P$, the winding is carried on, in the case when $P<2W/\sin\theta$, while controlling at least any one of P, S, and $(P-W/\sin\theta)$ so that $(1-W/P\sin\theta)<B<W/P\sin\theta$, or, in the case when $(P-W/\sin\theta)/W$ is $\frac{1}{3}$ or less, the winding is carried on while controlling at least either P or $(P-W/\sin\theta)$ so that $0.25\leqq B\leqq 0.75$.

In the practice of the present method, the width of the narrow strip parallel to the bobbin axis Wa is $W/\sin\theta$ and the gap between the adjacent layered turns of the strip G is $(P-Wa)$. That is, the pitch P is $(G+Wa)$. On the other hand, if the pitch P of the stroke S of either the narrow strip or bobbin is not a multiple of a half of the pitch P, the rotational number of the bobbin per reciprocating traverse entails a decimal part. Consequently, the strip in the second reciprocating traverse is wound staggeredly on the turns formed by the first traverse.

At that time, if the decimal part B is between $(1-Wa/P)$ and $Wa/P$, the both edges of the strip in the second reciprocating traverse are supported by the turns of the strip formed during the preceding first traverse, and there occurs no depression or collapse between turns. The same function is achieved, when $G/W<\frac{1}{3}$, by adjustment to obtain $0.25\leqq B\leqq 0.75$.

DETAILED DESCRIPTION

An embodiment of the invention will now be described with reference to the accompanying drawings.

Figure 2:
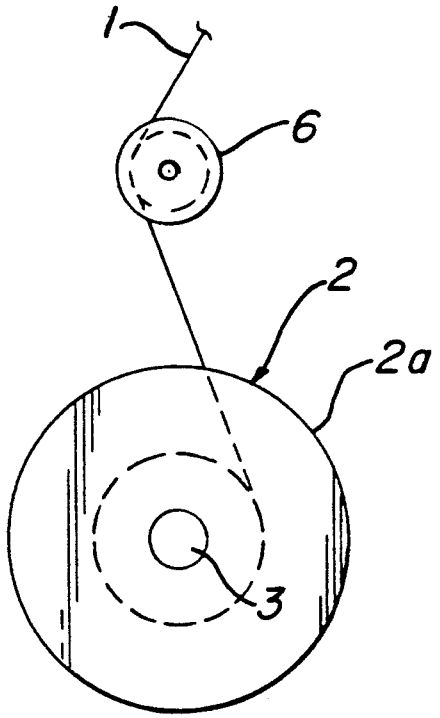
FIGS. 2 and 3 are side and front elevational views, respectively, of the main parts of a winding apparatus embodying the invention.
Figure 3:
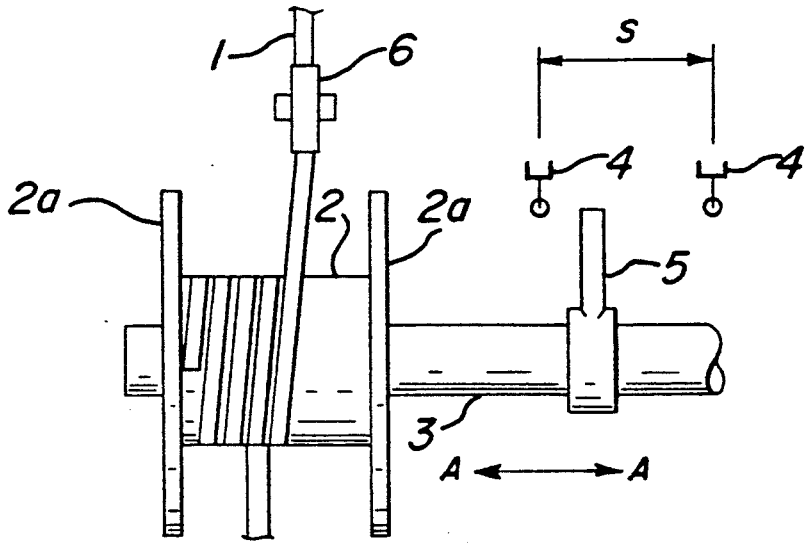
Figure 4A:
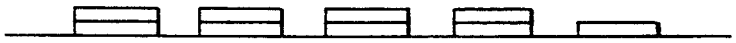
FIG. 4 shows sectional views for illustrating the functions of the embodiment.
Figure 4B:
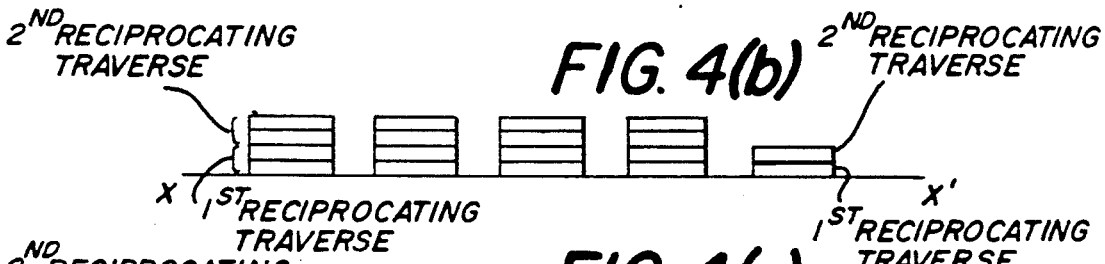
Figure 4C:
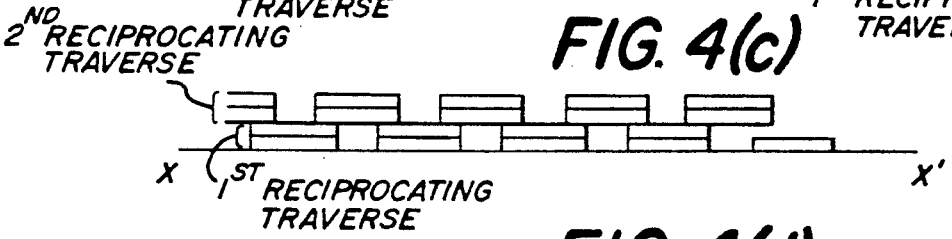
Figure 4D:
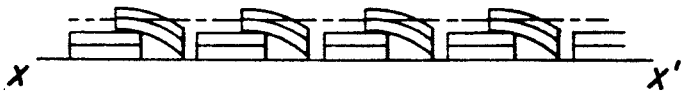
Figure 5A:
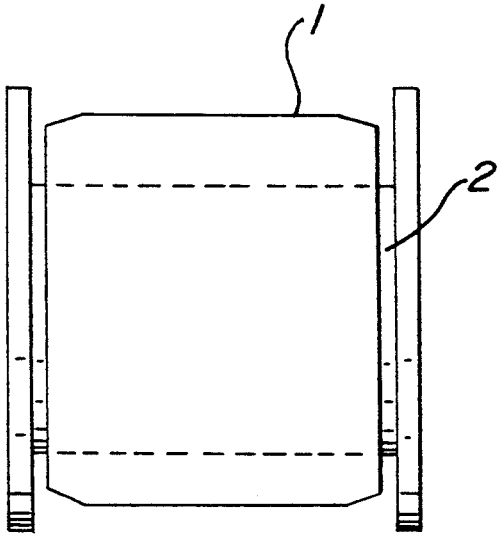
FIGS. 5*a* and 5*b* are front elevational views showing the states of strips soundly and poorly wound on bobbins, respectively.
Figure 5B:
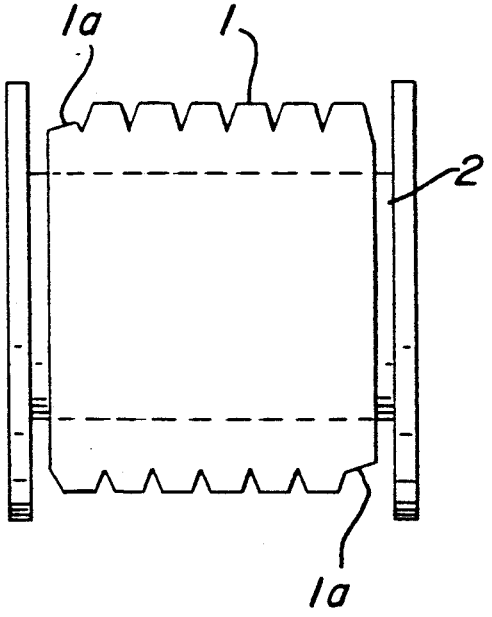

FIGS. 2 and 3 are side and front elevational views, respectively, of the main parts of a winder used in this embodiment.

Referring to the figures, the rotating shaft 3 of a bobbin 2 is supported rotatably and axially slidably by bearing means not shown. The bobbin is driven for rotation by a driving power source not shown via the rotating shaft 3.

The driving shaft 3 is driven also back and forth in the directions of the arrows A—A by driving power source not shown. A pair of limit switches 4 are provided to shift the moving direction of the shaft within a predetermined stroke S. On the rotating shaft 3 is fixedly mounted a dog 5 which comes into alternate contact with the limit switches 4.

Flanges 2*a* are provided at the both ends of the bobbin 2, and a guide roll 6 is held between and above the flanges 2*a*, so that a narrow strip 1 is fed via the guide roll 6 to the bobbin 2 and is wound around it by the rotational and reciprocal movements of the bobbin.

Next, the method of winding the narrow strip 1 in the embodiment of the invention will be explained below in conjunction with FIGS. 1 and 3.

Figure 1:
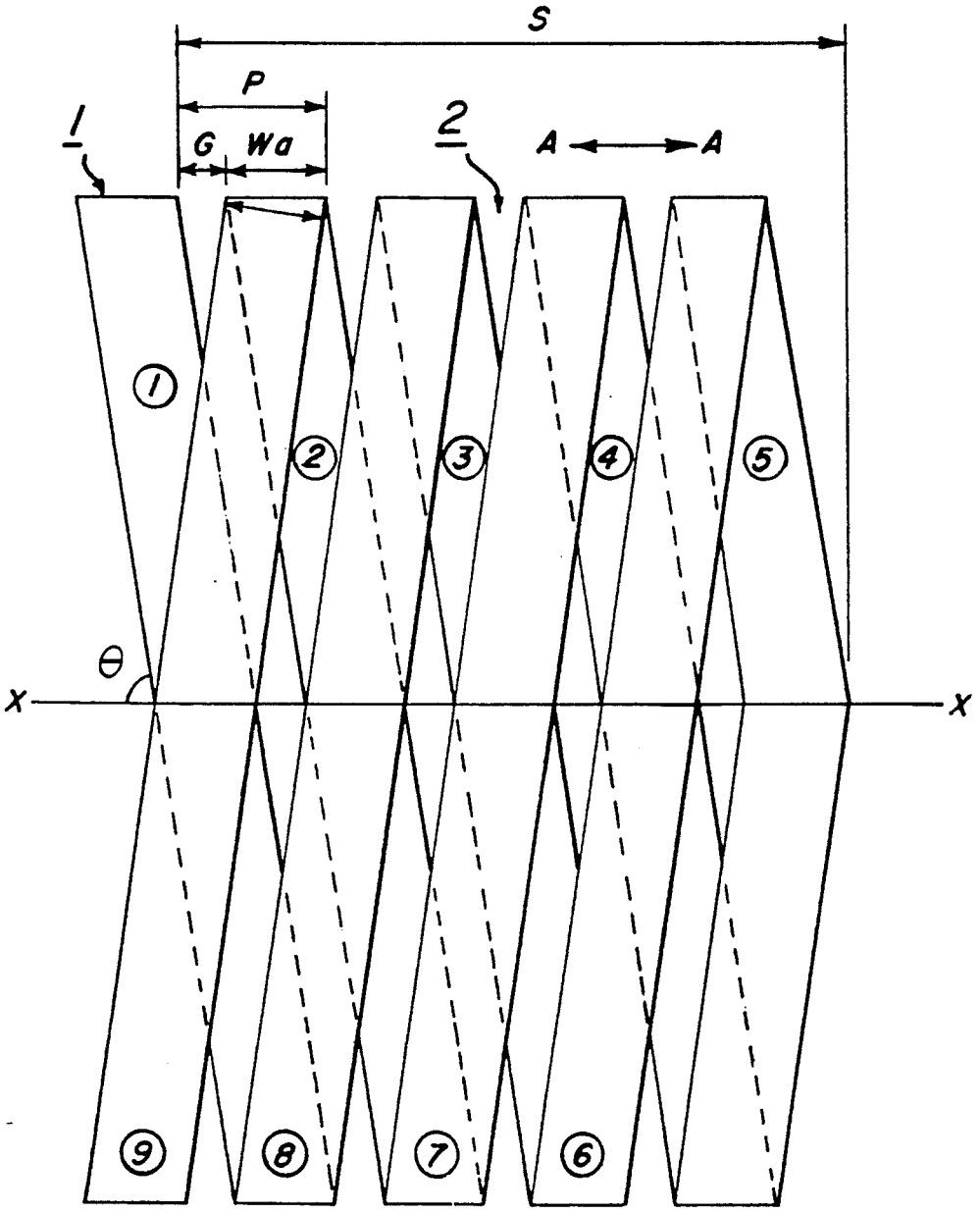
FIG. 1 is a developmet view illustrating how a narrow strip is wound in an embodiment of the invention.

FIG. 1 is a 360-deg. development of the circumference of the bobbin 2, with the narrow strip 1 wound thereon by one reciprocating traverse.

The strip 1 is shown having been wound by traversing from one end to the other end and back in the order of ① to ⑨. With the strip ⑤ at the turn, the turns ⑥ to ⑨ overlap the turns ① to ⑤, respectively. Hatched are the portions of the bobbin 2 exposed between the turns of the strip 1.

The symbols in the figure represent dimensions, angles, etc. as defined below:

S: the stroke in the movement in either direction A—A of the bobbin 2

W: the width of the strip 1

$\theta$: the angle the rotating shaft 3 of the bobbin 2 makes with the strip 1

$Wa=W/\sin\theta$: The width of the strip 1 as measured parallel to the rotating shaft 3

G: the gap between adjacent turns of the strip 1

$P=Wa+G$: the pitch of winding of the strip 1

$n=2S/P$: the number of rotations of the bobbin per reciprocating traverse of the bobbin 2

$n = A + B$

A: the integral part of n

B: the decimal part of n

FIG. 4 (*a*) is a cross sectional view taken onthe line X—X of FIG. 1, and FIGS. 4(*b*) to (*d*) are the sectional views in the same position of the strip 1 wound on the bobbin 2 after two reciprocating traverses where $P < 2Wa$.

FIG. 4 (b) represents the situation in which $B = 0$. The turn of the strip 1 in the second reciprocating traverse is superposed on the corresponding turn of the first traverse in exact alignment. In the middle part, therefore, four layers of the strip 1 are superposed whereas only two are superposed at one end, forming a step. In this state the circumferential surface of the bobbin 2 remains partly exposed between the strip sections or turns, as hatched in FIG. 1.

In FIG. 4 (*c*), $B = 0.5$, the strip turns (6) to (9) during the second reciprocating traverse are wound, respectively, over the turns to (1) to (5), staggered by a distance corresponding to the decimal part of the number of revolutions of the bobbin. The amount of stagger or discrepancy being ½ of the pitch P, the gap between the strip sections wound in the first reciprocating traverse is covered by the sections in the second traverse. Thus, if the strip in the second reciprocating traverse is to cover the gap formed by the first traverse, it is only necessary that $(1 - Wa/P) < B < Wa/P$.

FIG. 4 (*d*) shows the state in which B is outside the range mentioned above and is close to 0 to 1. One edge of the strip in the second reciprocating traverse falls unsupported by the turns of the strip formed by the first traverse. Thus, the numbers of turns of the strip 1 differ widely between the middle and both end portions of the bobbin. The layers of the turns consequently sink partly to form steps.

As described above, winding performed under conditions other than $(1 - Wa/P) < B < Wa/P$ tends to cause collapse, damage, break or other imperfection of the strip 1 due to the depression at the ends of the strip wound on the bobbin, as in (b) and (d) of FIG. 4. If the strip is wound instead under the above-defined condition, as in FIG. 4(*c*), the helical gap formed between the turns of the strip in the first reciprocating traverse is covered by the turns of the strip in the second traverse. A soundly wound state is thus attained accompanyed with no depression of wound layers.

In order that the bobbin can accommodate a greater length of the strip per reciprocating traverse, the gap G between the turns of the strip 1 may be made considerably narrower than the width W of the strip, say to $G/W < \frac{1}{3}$. Here again, for the reasons stated already, a sound winding is ensured by adjustment to be $0.25 \leqq B \leqq 0.75$.

As will be understood from the foregoing explanations, the strip can be soundly wound on a bobbin by adjusting the value of B that depends delicately upon the values of P and S when $P < 2Wa$, to $(1 - Wa/P) < B < Wa/P$ or when $G/W < \frac{1}{3}$, to $0.25 \leqq B \leqq 0.75$, preferably to the vicinity of 0.5.

While the embodiment of the invention has been described with the bobbin 2 being moved axially back and forth, the same applies to the reciprocating traverse of the strip 1 instead.

EXAMPLES

Table 1 summarizes actual instances of strip winding on bobbins. The Table gives the values of P, $\theta$, $(1 - W/P \sin\theta)$, $W/P \sin\theta$, S, n, A, B, and the evaluation of wound states of strips of two different widths, 20 and 30 mm, wound on bobbins each measuring 500 mm in outside diameter and 400 mm in width.

In Table 1, Nos. 1 through 7 are examples of the present invention. In Nos. 5 to 7 of these examples the value of P was not preset but was controlled so that the B value at the start of winding was in the proximity of 0.5.

The Nos. 5 to 7 examples, as well as Nos. 1 to 4 examples, produced desirably wound states.

Nos. 8 to 11 are comparative examples, of which Nos. 8 and 9 used the conditions of No. 4 with the exception that the P value was delicately changed. Unlike No. 4, these two comparative examples showed that a change of the order of one millimeter in the P value resulted in depressions at the ends. No. 10, which used a somewhat larger S value but otherwise followed the conditions of No. 4, showed a B value of zero and heavy depressions. No. 10 involved winding as illustrated in FIG. 4 (*d*), with any breakings of strip.

It will be appreciated from the results that very desirable wound configurations can result from the control of the B value which is delicately dependent on the values of P and S.

TABLE 1

| | No. | W (mm) | P (mm) | $\theta$ (deg) | $1 - \frac{W}{P\sin\theta}$ | $\frac{W}{P\sin\theta}$ | S (mm) | n A | n B | Wound state |
|---|---|---|---|---|---|---|---|---|---|---|
| Example of invention | 1 | 20.0 | 25.0 | 89.1 | 0.20 | 0.80 | 370 | 29 | 0.60 | Good |
| | 2 | 20.0 | 23.0 | 89.2 | 0.13 | 0.87 | 370 | 32 | 0.61 | " |
| | 3 | 30.0 | 38.0 | 88.6 | 0.21 | 0.79 | 350 | 18 | 0.42 | " |
| | 4 | 30.0 | 35.0 | 88.7 | 0.14 | 0.86 | 375 | 21 | 0.43 | " |
| | 5 | 20.0 | * | * | * | * | 375 | 30 | 0.51 | " |
| | 6 | 20.0 | * | * | * | * | 370 | 28 | 0.45 | " |
| | 7 | 30.0 | * | * | * | * | 360 | 20 | 0.42 | " |
| Comparative Example | 8 | 30.0 | 34.0 | 88.8 | 0.12 | 0.88 | 375 | 22 | 0.06 | Depressed at ends |
| | 9 | 30.0 | 35.6 | 88.7 | 0.16 | 0.84 | 375 | 21 | 0.06 | " |
| | 10 | 30.0 | 35.0 | 88.7 | 0.14 | 0.86 | 385 | 22 | 0.00 | " |
| | 11 | 30.0 | 39.0 | 88.6 | 0.25 | 0.77 | 355 | 18 | 0.21 | Broken |

* "B" adjusted without being preset.

ADVANTAGES OF THE INVENTION

According to the present invention, as described above, a narrow strip can be wound on a bobbin in a desirable state while avoiding any collapse or other disorder in winding or any damage of the strip, by adjusting the decimal part of the number of rotations of the bobbin per reciprocating traverse of the bobbin within a predetermined range.

What we claim is:

1. A method of winding a narrow strip having a width W on a cylindrical bobbin having a central axis of rotation, said strip being wound at an angle $\theta$ to the axis of the bobbin and at a pitch P, comprising the steps of moving said bobbin and said strip reciprocally relative to each other back and forth along the axis of the bobbin over an axial stroke distance S while winding said strip on said bobbin, and rotating said bobbin a number of turns equal to n for each reciprocating stroke S of said bobbin or strip, said number n having an integer part A and a decimal part B, said number n being expressed according to the formula $n=2S/P$, where $P<2W/\sin\theta$ while controlling at least one of P, S, and $(P-W/\sin\theta)$ so that $(1-W/P\sin\theta)<B<W/P\sin\theta$.

2. A method according to claim 1, in the case when $(P-W/\sin\theta)/W$ is not greater than $\frac{1}{3}$, wherein at least one of P and $(P-W/\sin\theta)$ is controlled so that $0.25\leqq B\leqq 0.75$.

* * * * *